US007443266B2

(12) United States Patent
Razmpoosh

(10) Patent No.: US 7,443,266 B2
(45) Date of Patent: Oct. 28, 2008

(54) VARIABLE POWER COUPLING DEVICE

(75) Inventor: Bahram Razmpoosh, Quebec (CA)

(73) Assignee: Harris Stratex Networks, Inc., Morrisville, NC (US)

( * ) Notice: Subject to any disclaimer, the term of this patent is extended or adjusted under 35 U.S.C. 154(b) by 0 days.

(21) Appl. No.: 11/773,301

(22) Filed: Jul. 3, 2007

(65) Prior Publication Data

US 2007/0268090 A1 Nov. 22, 2007

Related U.S. Application Data

(63) Continuation of application No. 10/879,634, filed on Jun. 30, 2004.

(51) Int. Cl.
*H01P 5/12* (2006.01)

(52) U.S. Cl. ..... 333/125; 333/109; 333/115; 333/116; 333/117

(58) Field of Classification Search ..... 333/109, 333/115, 116, 117, 125
See application file for complete search history.

(56) References Cited

U.S. PATENT DOCUMENTS 3,611,153 A * 10/1971 Wen ..... 455/327
4,352,071 A 9/1982 Childs et al.
4,969,701 A 11/1990 Papuchon et al.
5,119,447 A 6/1992 Trisno
5,349,364 A 9/1994 Bryanos et al.
5,359,680 A 10/1994 Riviere
5,410,281 A 4/1995 Blum
5,543,762 A 8/1996 Sigmon
5,889,444 A 3/1999 Johnson et al.
6,148,122 A 11/2000 Cao et al.
6,225,874 B1 5/2001 Kerley
6,756,859 B2 6/2004 Kodim

OTHER PUBLICATIONS

Razmpoosh, B., et al.; "Microwave Planar Circuit and Microstrip Discontinuities Characterization"; The Third Biennial IEEE Conference on Electromagnetic Field Computation; Dec. 12-14, 1988; 8 pages.
Razmpoosh, B., et al.; "Microwave Planar Circuit and Microstrip Discontinuities Characterization"; IEEE Transactions on Magnetics; vol. 25, No. 4; Jul. 1989; pp. 2995-2997.

* cited by examiner

*Primary Examiner*—Robert J. Pascal
*Assistant Examiner*—Kimberly E Glenn
(74) *Attorney, Agent, or Firm*—Sheppard, Mullin, Richter & Hampton LLP

(57) ABSTRACT

An apparatus and method for providing adaptive control of the output of a radio frequency coupler. Adaptive control may include providing a transmission line having a plurality of branches extending therefrom and terminating, correspondingly, with a plurality of terminals and terminating, at its opposite end, with a single terminal, as well as, providing one or more proximate transmission lines inductively coupled with the transmission line and each having an input terminal at one end. Application of one or more input signals, respectively, to the one or more proximate transmission lines can adaptively control, via the inductive coupling, either a combination signal which is produced from a plurality of incoming signals when received at the plurality of terminals and is output from the single terminal or a plurality of outgoing signals which are produced from an incoming signal when received at the single terminal and divided among the plurality of branches and which are output from the plurality of terminals.

20 Claims, 4 Drawing Sheets

VARIABLE POWER COUPLING DEVICE

REFERENCE TO EARLIER-FILED APPLICATION

This is a Continuation Application of and incorporates by reference U.S. patent application Ser. No. 10/879,634, filed Jun. 30, 2004, titled "Variable Power Coupling Device."

BACKGROUND

Microwave power combiners/dividers are used in different circuit applications. One such application is the combination of several incoming signals to achieve a coherent output signal having the desired output power. Conversely, an incoming signal may be divided to provide several output signals for digital signal processing devices.

Conventional combiners/dividers include a plurality of branches (fingers) couples to a unitary terminal. When used as a divider, an input signal is supplied to the unitary terminal and is transmitted to the several branches. When used as a power combiner, several input signals are supplied simultaneously to the respective branches and combined to one output signal at the unitary terminal.

A well-known combiner/divider is the Wilkinson power divider. The Wilkinson device is conventionally used for binary dividing/combining; that is, successive divisions or multiplications by two. Hence, the Wilkinson device is limited in that the divisions or multiplications are always a factor of 2 and the input and output impedances are equal to characteristic impedance $Z_0$. Regardless of its application as a combiner or a divider, the Wilkinson device does not allow different input/output impedances. Moreover, since the Wilkinson device uses quarter-wavelength line in each division/multiplication operation and is binary, each subsequent operation requires additional space for the additional quarter-wavelength lines. Most importantly, the Wilkinson device does not allow N-way combination or division response in dimensional circuits. Circuits may be categorized in four groups according to their dimensions: zero dimensional, one dimensional, two dimensional and three dimensional. For example, in two dimensional circuits, two dimensions of the circuit are comparable or larger than the wavelength of the corresponding frequency. The other dimension is much smaller than the wavelength; therefore, these circuits may be categorized as two dimensional or 2D.

Other conventional combiners/dividers provide multi-prong impedance transforming power devices have a first terminal (corresponding to a first transmission line) and N transmission line fingers. The transmission lines have first and second ends. At their second end, the transmission lines are coupled to the first terminal while at their second terminal they are positioned to electromagnetically communicate with a power source. When used as a combiner, power is provided to each of the transmission lines. When combined, the power from each transmission line is combined to form an output from the first terminal. A drawback of the multi-prong impedance is the failure to provide control of the impedance transformation functions over a broad band of frequencies, while simultaneously achieving a wide range of possible impedance transformations. That is, the multi-prong device is limited to providing substantially linear output/input.

Clearly, there is a need in the art for power combiner/divider apparatus that overcomes the shortcoming of the prior art.

SUMMARY

Various exemplary embodiments as shown and described herein and in the accompanying drawings address these and related issues.

DETAILED DESCRIPTION OF THE INVENTION

Figure 1:
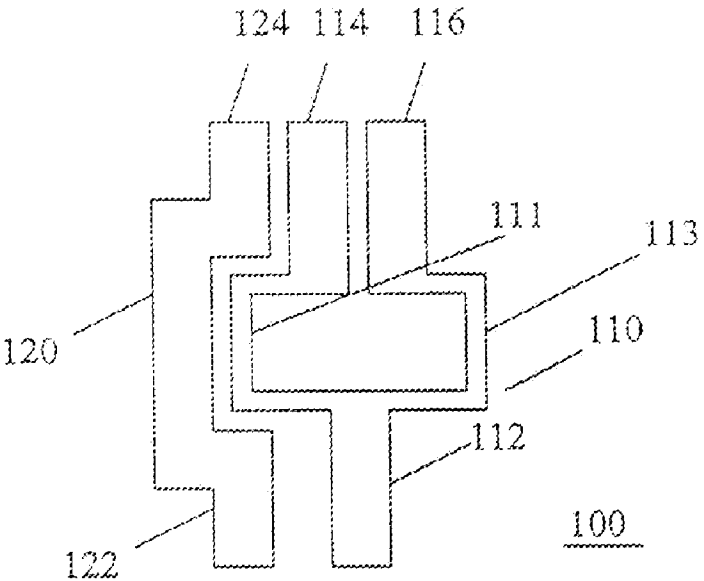
FIG. 1 is a schematic illustration of a variable coupling device according to one embodiment of the invention.

FIG. 1 is a schematic illustration of a variable coupling device according to one embodiment of the invention. Referring to FIG. 1, a coupler 100 has a first transmission line 110 and a second transmission line 120. The first transmission line 110 includes a first terminal 112 that can receive an incoming signal (not shown) or provide an output signal. The first transmission line 110 also includes a first branch 111 and second branch 113. The first branch 111 ends in a second terminal 114 while the second branch 113 ends in a third terminal 116. Both the second terminal 113 and third terminal 116 can receive an incoming signal or transmit an output signal.

The second transmission line 120 has a fourth terminal 122 and a fifth terminal 124 each of which may receive an incoming signal or transmit an output signal, depending on the application of the coupler 100 and can be positioned in close proximity to the first transmission line 110 such that the second transmission line 120 is inductively engaged to the first transmission line 110. Although not specifically shown in the exemplary embodiment of FIG. 1, the second transmission line 120 can be inductively couples to the first branch 111 or second branch 113. To provide the desired inductive effect, the proximity of the first and the second terminals can be in the range of 5 to 40 mil (0.13 to 1 mm) with a dielectric constant ($\epsilon r$) of 3.5 and thickness of 20 mil (0.5 mm) at frequencies up to 8 GHz in 1D circuits. Thus, if a terminal of the second transmission line 120 receives an incoming signal, a portion of the power from the incoming signal inductively engages the first transmission line 110 to thereby alter the power signal output of the first transmission line 110.

The coupler may be positioned on a dielectric substrate or other suitable medium and comprised of conductive or semi-conductive materials. Further, the coupler may function over a broad range of frequencies and is suitable for use in various technologies employing microstrip techniques including but not limited to microwave communications, millimeter wave communications, point-to-point and point-to-multipoint wireless communications, satellite communications, and fixed and mobile radar systems.

Each of the first and second terminals can be constructed of conductive or semi-conductive material such as those used in conventional couplers. For example, any microstrip (planar) media, such as microwave monolithic integrated circuitry (MMIC) can be used to implement the embodiment of FIG. 1.

In such an embodiment, the parallel transmission line spacing 121 can range from approximately 5 to 40 mil (0.13 to 1 mm) with a dielectric constant (εr) of 3.5 and thickness of 20 mil (0.5 mm) at frequencies up to 8 GHz in 1D circuits. In 2D circuits, the frequencies may extend up to 100 GHz.

A key feature of the disclosed invention is the compact size of the variable coupler. Compact designs are particularly important when considering semiconductor die fabrication, particularly when gallium arsenide (GaAs) is used as a substrate. For example, the length and impedance of the first branch 111 and the second branch 113 may be determined by a divider (or sum) ration with the length and impedance of the first terminal 112. The impedance of the second transmission line 120 may match the impedance of the coupled branch. In this example, the impedance of the second transmission line 120 may match the impedance of the first branch 111.

When used as a variable power divider, the coupling device 100 can be positioned to receive an incoming signal at the first terminal 112 and provide outputs at each of the second terminal 114 and the third terminal 116. To provide a variable power output, the second transmission line 120 can be place in electromagnetic proximity of either the first branch 111 or the second branch 113. In the embodiment of FIG. 1, the second transmission line 120 is positioned adjacent to the first branch 111. If power is supplied to the second transmission line 120 via the fourth terminal 122, electromagnetic inductance will be formed in the second transmission line 120. The inductance will affect the current flowing through the first branch 111 so as to increase or decrease the signal power output at the second terminal 114. A desired signal output at each of the second and third terminals can be obtained by varying the power supplied to the second transmission line 120, by adjusting the proximity (or length) of the second transmission line 120 and the first branch 111, or both. While not specifically shown in FIG. 1, the fifth terminal 124 can be terminated to a proper load.

When used as a power combiner, each of the second terminal 114 and third terminal 116 receives an input signal. The input signals can be uniform or can have different signal powers. That is, the input signal to each of the second terminal 114 and third terminal 116 may have the same or different frequencies. In a conventional Wilkinson combiner, the input signals to each of the second and third terminals are combined to form an output signal from the first terminal 112. An obvious drawback is that the conventional coupler provides a linear combination of the input signal. In contrast, according to one embodiment of the invention an input signal can be provided to the fifth terminal 124 to inductively control the signal flow through the first branch 111 (that is, the inductive coupling between the first branch 111 and the second transmission line 120 can actively increase/decrease the power magnitude supplied to the first terminal 112). As with the variable power divider embodiment described above, the output signal power from the first terminal 112 can be adjusted by adjusting the proximity and/or length of the second transmission line 120 and the first branch 111.

Figure 2A:
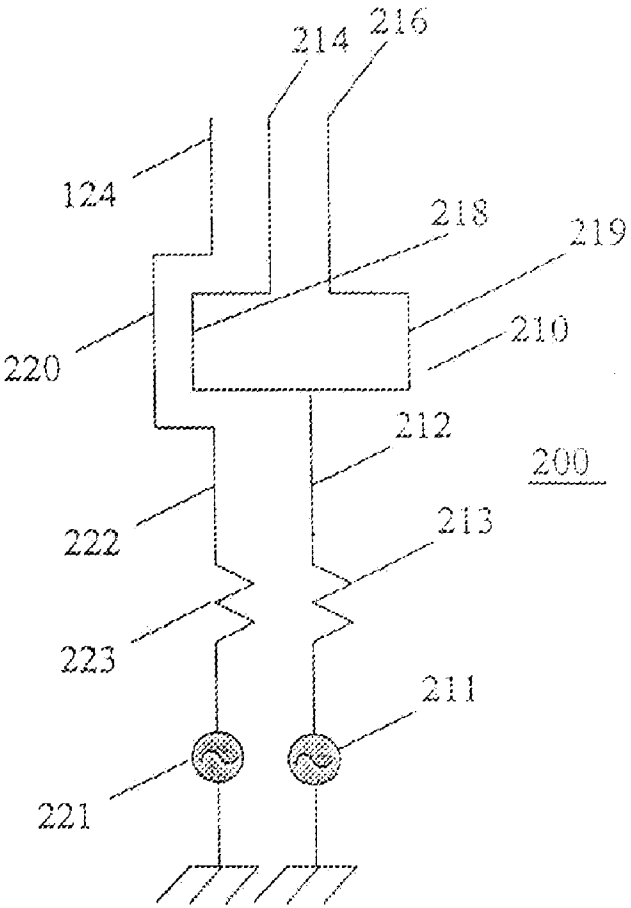
FIG. 2*a* schematically represents a frequency coupler according to one embodiment of the invention.

FIG. 2*a* schematically represents a frequency coupler according to one embodiment of the invention. As shown in FIG. 2*a*, the variable frequency divider 200 includes a first transmission line 210 having a first terminal 212 that receives an incoming signal 211 of frequency $f_1$. The first terminal 212 can be represented as having an equivalent characteristic impedance 213 with a value of $Z_{213}$. The first terminal 212 divides to a first branch 218 and second branch 219 which terminate in a second terminal 214 and third terminal 216, respectively. A second transmission line 220 includes a fourth terminal 222 that receives an incoming signal 221 of frequency $F_2$. In the exemplary embodiment of FIG. 2*a*, the fourth terminal 222 is represented as having an equivalent characteristic impedance $Z_{223}$. The proximate positioning of the first terminal 212 and fourth terminal 222 allows for electromagnetic influence among $Z_{213}$ and $Z_{223}$. Consequently, the output at each of the second and third terminals (214, 216, respectively) can be adjusted by controlling signal frequency $f_2$.

Figure 2B:
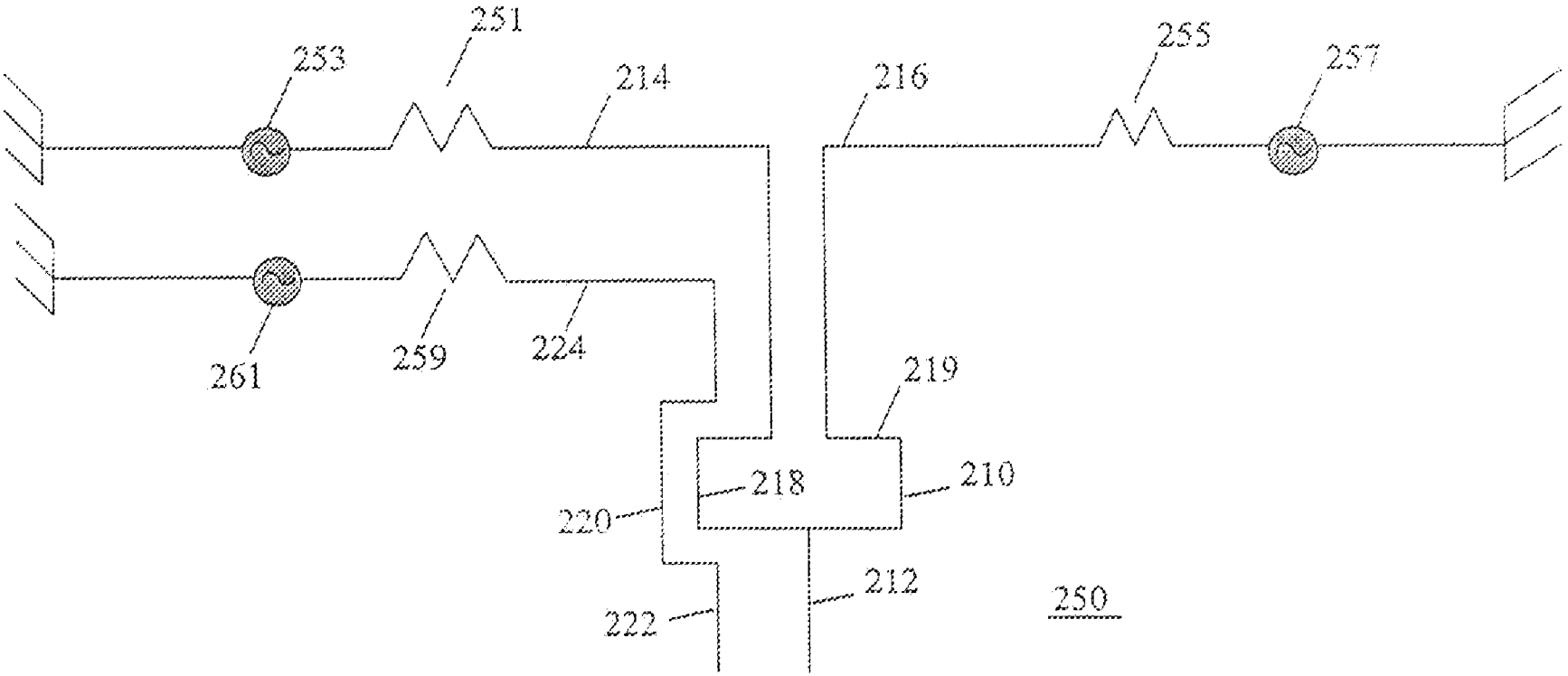
FIG. 2*b* schematically represents a frequency divider according to one embodiment of the invention.

FIG. 2*b* schematically represents a frequency combiner according to one embodiment of the invention. The variable frequency combiner 250 has similar elements as the elements of the variable frequency divider 200 represented in FIG. 2*a*. Therefore, similar elements will maintain like reference numbers. The variable frequency combiner 250 comprises a first transmission line 210 and a second transmission line 220. The first transmission line 210 is defined by an output terminal 212, a first branch 218 and a second branch 219. The first branch 218 is shown with an impedance 251 ($Z_{251}$) and receives an incoming signal 253. Similarly, the second branch 219 is shown with an impedance 255 ($Z_{255}$) receiving an incoming signal 257. The second transmission line 220 is positioned proximally to the first branch 218 and comprises an impedance 259 ($Z_{259}$) and a fourth terminal 222 and receives an incoming signal 261. Each of the incoming signals 253, 257 and 261 may be signals of different frequency and power. Each of the incoming signals 253, 257 and 261 may be generated by a signal generator (not shown). Proximity of the second transmission line 220 to the first branch 218 of the first transmission line 210 enables electromagnetic coupling between the impedance 259 of the second transmission line 220 and the impedance 251 of the first branch 218. Depending on the respective values of $Z_{251}$ and $Z_{259}$, the electromagnetic coupling will affect the signal being transmitted through the second terminal 214 and the second transmission line 220. Consequently, the signal output from an output terminal can be more than a linear combination of the incoming signals 253 and 257.

The inventive embodiment of FIGS. 1, 2*a* and 2*b* can be represented as an equivalent circuit satisfying the following relationships:

$$[S] = \begin{bmatrix} [S]_w & [S]_c \\ [S]_{cl} & [S]_j \end{bmatrix}, [R]_o = \begin{bmatrix} R_{o1} & 0 & 0 & 0 & 0 \\ 0 & R_{o2} & 0 & 0 & 0 \\ 0 & 0 & R_{o3} & 0 & 0 \\ 0 & 0 & 0 & R_{o4} & 0 \\ 0 & 0 & 0 & 0 & R_{o5} \end{bmatrix}$$

where $[S]_w$ is 3×3, $[S]_c$ is 2×3, $[S]_{ct}$ is 3×2, $[S]_l$ is 2×2 and $[R]_o$ is a termination matrix. The [S] depends upon a Wilkinson, balanced/unbalanced coupler arm that should be matched with an associated Wilkinson arm, termination matrix and frequency.

An exemplary approximate normalized matrix with termination may be represented by the following relationship:

$$S = \begin{bmatrix} 0 & 0.7 & 0.5 & 0 & 0.55 \\ 0.7 & 0.7 & 0 & 0 & 0 \\ 0.5 & 0 & 0.7 & 0.55 & 0 \\ 0 & 0 & 0.55 & 0.7 & 0.45 \\ 0.55 & 0 & 0 & 0.45 & 0.7 \end{bmatrix}$$

Although in the exemplary embodiments of FIGS. 2*a* and 2*b*, the characteristic impedances are positioned in the represented location, it shall be understood by those of skill in the art that such placements are only exemplary and do not limit the principles of the invention disclosed herein. Moreover, the respective impedances are provided to illustrate an equivalent circuit function of the variable coupler, as known to those of skill in the art.

Figure 3:
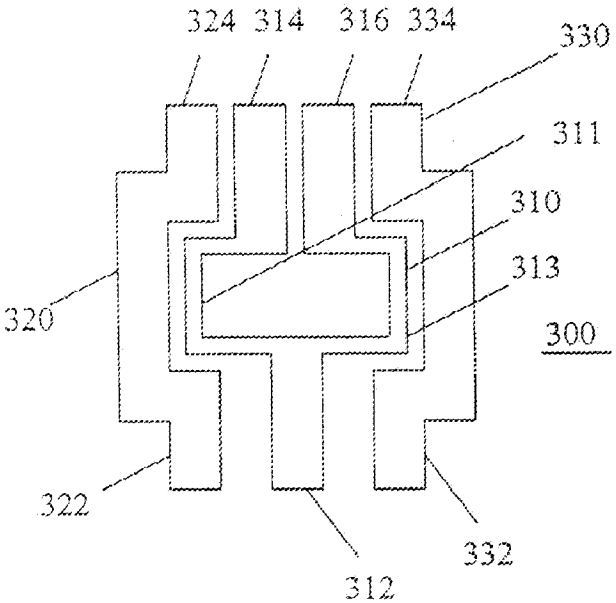
FIG. 3 shows a variable frequency coupler according to another embodiment of the invention.

FIG. 3 shows a variable frequency coupler 300 according to another embodiment of the invention. Depending on how it is configured, the variable frequency coupler 300 can be used as a signal divider or a combiner. The coupler of FIG. 3 can be considered as a conceptual extension of the exemplary coupler of FIG. 1 in that the device of FIG. 3 enables additional signal manipulation by providing a third transmission line for electromagnetically affecting the second branch of the first transmission line.

Referring to FIG. 3, a first transmission line 310 is defined by a first terminal 312, second terminal 314 and third terminal 316 interconnected through a first branch 311 and a second branch 313. If the coupler 300 is used as a variable power divider, the first terminal 312 is used as input and the second terminal 314 and third terminal 316 are used as outputs. Conversely, if the coupler 300 is used as a variable power combiner, the first terminal 312 is used as output and the second terminal 314 and third terminal 316 are used as inputs. For use as a variable power divider, the first terminal divider 312 can receive an input signal. When used as a variable combiner, the second terminal 314 and third terminal 316 can receive signals having the same or different frequencies. A second transmission line 320 and third transmission line 330 can be positioned in proximity of the first branch 311 and second branch 313, respectively. Referring to the second transmission line 320, either of the fourth terminal 322 or the fifth terminal 324 can receive an input signal. While not specifically shown in FIG. 3, the fourth terminal 322 or fifth terminal 324 can be terminated to a proper load. Similarly, the third transmission line 330 can be adapted to have either of a sixth terminal 332 or a seventh terminal 334 receive an input signal. While not specifically shown in FIG. 3, the sixth terminal 332 or seventh terminal 334 may be coupled to proper loads or sources.

For example, if used as a power divider, variable frequency coupler 300 can be positioned to receive an incoming signal at the first terminal 312 and provide subsequent outputs at each of the second terminal 314 and third terminal 316. To provide variable output at each of the second terminal 314 and third terminal 316, the second transmission line 320 and third transmission line 330 can be positioned in electromagnetic proximity to the first branch 311 and the second branch 313, respectively. If power is supplied to the second transmission line 320 via the fourth terminal 322 or fifth terminal 324, electromagnetic inductance will be formed in the second transmission line 320. The inductance will affect the current flowing through the first branch 311 so as to increase or decrease the signal power output at the second terminal 314. Similarly, if power is supplied to the third transmission line 330 via the sixth terminal 322 or seventh terminal 332, electromagnetic inductance will be formed in the third transmission line 330. The inductance will affect the current flowing through the second branch 313 so as to increase or decrease the signal power output at the third terminal 316. Each of the transmission lines can be charged with an input signal of similar or different magnitude. The current flow direction can be optionally consistent with that of the first transmission line 310. Thus, the terminals in the second transmission line 320 and third transmission line 330 can be coupled to a signal specifically calculated to induce the desired electromagnetic coupling on the respective first branch 311 and second branch 313.

Placement of the second and third transmission lines 320 and 330 in proximity to the first transmission line 310 can be in a range of 5 to 40 (0.13 to 1 mm) with a dielectric constant ($\epsilon r$) of 3.5 and thickness of 20 mil (0.5 mm) at frequencies up to 8 GHz in 1D circuits.

Figure 4A:
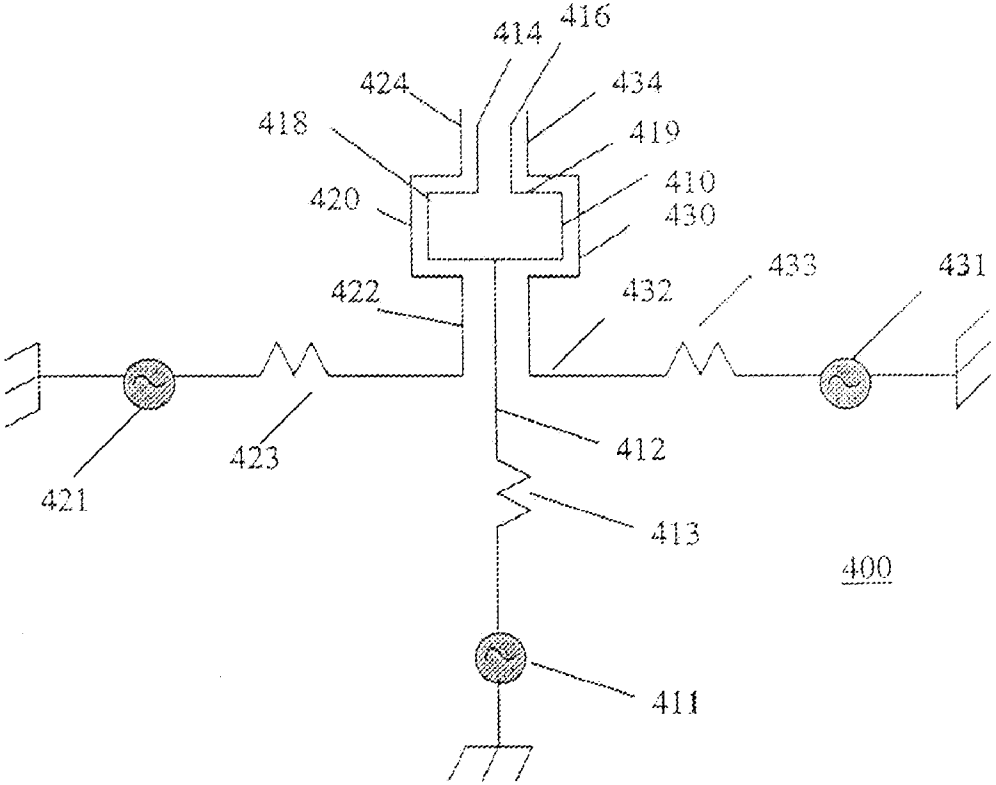
FIG. 4*a* is a circuit diagram of another embodiment of the invention.

FIG. 4*a* schematically represents a frequency coupler of another embodiment of the invention. As shown in FIG. 4*a*, the variable frequency divider 400 includes a first transmission line 410 having a first terminal 412 receiving an incoming signal 411 of frequency $f_1$. The first terminal 412 can be represented as having an equivalent characteristic impedance 413 with and impedance value of $Z_{413}$. The first terminal 412 divides to a first branch 418 and second branch 419 which terminate in a second terminal 414 and third terminal 416, respectively. A second transmission line 420 includes a fourth terminal 422 receiving an incoming signal 421 of frequency $f_2$. A third transmission line 430 includes a sixth terminal 432 receiving an incoming signal 431 of frequency $f_3$. In the exemplary embodiment of FIG. 4*a*, the fourth terminal 422 is represented as having an equivalent characteristic impedance $Z_{423}$ and the sixth terminal 432 is represented as having an equivalent characteristic impedance $Z_{433}$.

The length and proximate positioning of the first branch 418 and second transmission line 420 allow for electromagnetic influence among $Z_{413}$ and $Z_{423}$. The length and proximate positioning of the second branch 419 and third transmission line 430 allow for electromagnetic influence among $Z_{413}$ and $Z_{433}$. Consequently, the output at each of the second and third terminals (414, 416, respectively) can be adjusted by controlling signal frequency $f_2$ or signal frequency $f_3$ or both.

Figure 4B:
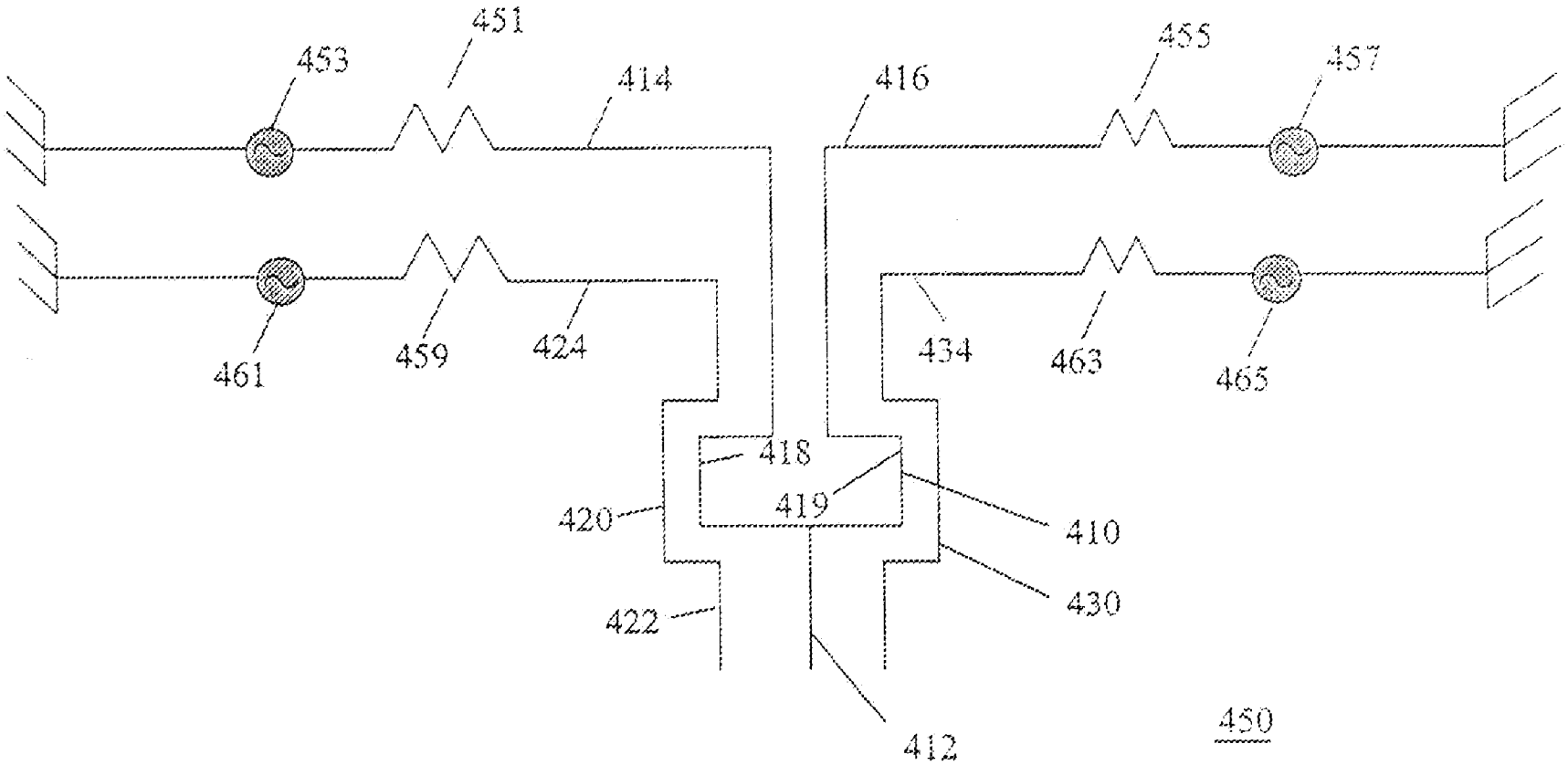
FIG. 4*b* is a circuit diagram of another embodiment of the invention.

FIG. 4*b* schematically represents a frequency combiner according to yet another embodiment of the invention. The variable frequency combiner 450 has similar elements as the elements of the variable frequency divider 400 represented in FIG. 4*a*. Therefore, similar elements will maintain like reference numbers. The variable frequency combiner 450 comprises a first transmission line 410, second transmission line 420 and third transmission line 430. The first transmission line 410 is defined by an output terminal 412 (also first terminal 412), a first branch 418 and a second branch 419. The first branch 418 is shown with an impedance 451 ($Z_{451}$) and receives an incoming signal 453. Similarly, the second branch 419 is shown with an impedance 455 ($Z_{455}$) receiving an incoming signal 457. The second transmission line 420 is positioned proximally to the first branch 418 and comprises an impedance 459 ($Z_{459}$) and a fifth terminal 424 receiving an incoming signal 461. The third transmission line 430 is positioned proximally to the second branch 419 and comprises an impedance 463 ($Z_{463}$) and a seventh terminal 434 receiving an incoming signal 465.

Each of the incoming signals 453, 457, 461 and 465 may optionally be signals of different frequency and power. Proximity of the second transmission line 420 to the first branch 418 enables electromagnetic coupling between the impedance 459 of the second transmission line 420 and the impedance 451 of the first branch 418. Proximity of the third transmission line 430 to the second branch 419 enables electromagnetic coupling between the impedance 463 of the third transmission line 430 and the impedance 455 of the second branch 419. Depending on the respective values of $Z_{451}$, $Z_{455}$, $Z_{459}$ and $Z_{463}$, the electromagnetic coupling will affect the power of the signal being transmitted through the first terminal 412 and the first transmission line 410. Consequently, the signal output from an output terminal can be more than a linear combination of the incoming signals 453, 457, and 461 and 465.

The inventive embodiments of FIGS. 3, 4*a* and 4*b* can be represented as an equivalent circuit satisfying the following relationships:

$$[S]=\begin{bmatrix}[S]_w & [S]_{c1} & [S]_{c2}\\ [S]_{ct1} & [S]_{l1} & [0]\\ [S]_{ct2} & [0] & [S]_{l2}\end{bmatrix},\ [R]_o=\begin{bmatrix}R_{o1} & & & & & & \\ & R_{o2} & & & & & \\ & & R_{o3} & & & & \\ & & & R_{o4} & & & \\ & & & & R_{o5} & & \\ & & & & & R_{o6} & \\ & & & & & & R_{o7}\end{bmatrix}$$

where $[S]_w$ is 3×3, $[S]_{ci}$ is 2×3, $[S]_{cti}$ is 3×2, $[S]_{li}$ is 2×2 and $[R]_o$ is a termination matrix. The [S] depends upon a Wilkinson, balanced/unbalanced coupler arm that should be matched with an associated Wilkinson arm, termination matrix and frequency.

An exemplary approximate normalized matrix with termination may be represented by the following relationship:

$$S=\begin{bmatrix}0 & .45 & .45 & 0 & .55 & 0 & .55\\ .45 & .7 & 0 & 0 & 0 & .55 & 0\\ .45 & 0 & .7 & .55 & 0 & 0 & 0\\ 0 & 0 & .55 & .7 & .45 & 0 & 0\\ .55 & 0 & 0 & .45 & .7 & 0 & 0\\ 0 & .55 & 0 & 0 & 0 & .7 & .45\\ .55 & 0 & 0 & 0 & 0 & .45 & .7\end{bmatrix}$$

Although in the exemplary embodiments of FIGS. 4*a* and 4*b*, the characteristic impedances are positioned in the represented location, it shall be understood by those of skill in the art that such placements are only exemplary and do not limit the principles of the invention disclosed herein. Moreover, the respective impedances are provided to illustrate an equivalent circuit function of the variable coupler, as known to those of skill in the art.

The variable frequency coupler of the present disclosure may be used for many different frequencies, i.e., 500 MHz to 8 GHz in 1D circuits and up to 60 GHz in 2D circuits, and many different waveforms and modulations. Further, the variable frequency coupler is suitable for use in microwave communications, millimeter wave communications, point-to-point and point-to-multipoint wireless communications and satellite communications as well as fixed and mobile radar systems as a modulated or non-modulated signal. The adaptive output control provided by the present disclosure also allows for versatility in a multiple frequency system with differing coupling values that are determined based on coupler geometrical structure and materials.

A device according to the principles of the invention can be used, for example, to receive radio frequency, microwave frequency as well as high power and high frequency applications and optical and laser applications.

While preferred embodiments of the present inventive apparatus and method have been described, it is to be understood that the embodiments described are illustrative only and that the scope of the embodiments of the present inventive apparatus and method is to be defined solely by the appended claims when accorded a full range of equivalence, many variations and modifications naturally occurring to those of skill in the art from a perusal thereof.

What we claim is:

1. A coupling device, comprising:

a transmission line having a plurality of branches extending therefrom and terminating, correspondingly, with a plurality of terminals, the transmission line terminating, at its opposite end, with a single terminal;

one or more proximate transmission lines inductively coupled with the transmission line and each having an input terminal at one end, wherein the one or more proximate transmission lines are capable of adaptively controlling, via the inductive coupling, a combination signal which is produced from a plurality of incoming signals when received at the plurality of terminals and is output from the single terminal and a plurality of outgoing signals which are produced from an incoming signal when received at the single terminal and divided among the plurality of branches and which are output from the plurality of terminals.

2. The coupling device of claim 1, configured as a combiner when producing the combination signal and configured as a divider when producing the plurality of outgoing signals.

3. The coupling device of claim 1, configured as a frequency combiner or frequency divider.

4. The coupling device of claim 1, configured as a power combiner or power divider.

5. The coupling device of claim 1, implemented in a wireless communication system.

6. The coupling device of claim 1, further comprising a source of one or more input signals used in the adaptive controlling.

7. The coupling device of claim 6, wherein the source is capable of changing the one or more input signals to adaptively affect the combination signal or the plurality of outgoing signals.

8. The coupling device as in claim 7, wherein the changing includes a change in the frequency of the one or more input signals.

9. The coupling device as in claim 1, wherein the inductive coupling depends on a distance between the transmission line and the one or more proximate transmission lines.

10. The coupling device as in claim 9, wherein the one or more proximate transmission lines are each terminated with a load at the other end.

11. The coupling device as in claim 1, arranged on a semiconductor substrate.

12. A coupling method, comprising:

providing a transmission line having a plurality of branches extending therefrom and terminating, correspondingly, with a plurality of terminals, the transmission line terminating, at its opposite end, with a single terminal;

providing one or more proximate transmission lines inductively coupled with the transmission line and each having an input terminal at one end, wherein the inductive coupling depends on a distance between the transmission line and the one or more proximate transmission lines; and applying one or more input signals, respectively, to the one or more proximate transmission lines for adaptively controlling, via the inductive coupling, either a combination signal which is produced from a plurality of incoming signals when received at the plurality of terminals and is output from the single terminal or a plurality of outgoing signals which are produced from an incoming signal when received at the single terminal and divided among the plurality of branches and which are output from the plurality of terminals.

13. The coupling method of claim 12, implemented in a frequency combiner or frequency divider.

14. The coupling method of claim 12, implemented in a power combiner or power divider.

15. The coupling method of claim 12, implemented in a wireless communication system.

16. The coupling method of claim 12, wherein the step of applying includes changing the one or more input signals to adaptively affect the combination signal or the plurality of outgoing signals.

17. The coupling method as in claim 16, wherein the changing includes a change in the frequency of the one or more input signals.

18. The coupling method as in claim 12, further including changing the distance so as to alter the inductive coupling.

19. The coupling method as in claim 12, further comprising selecting a length of and a distance between the one or more proximate transmission lines and the transmission line.

20. A coupling method, comprising:

providing a transmission line having a plurality of branches extending therefrom and terminating, correspondingly, with a plurality of terminals, the transmission line terminating, at its opposite end, with a single terminal;

providing one or more proximate transmission lines inductively coupled with the transmission line and each having an input terminal at one end; and applying one or more input signals, respectively, to the one or more proximate transmission lines capable of adaptively controlling, via the inductive coupling, a combination signal which is produced from a plurality of incoming signals when received at the plurality of terminals and is output from the single terminal and a plurality of outgoing signals which are produced from an incoming signal when received at the single terminal and divided among the plurality of branches and which are output from the plurality of terminals.

* * * * *